US008232497B2

(12) United States Patent
Gregoire et al.

(10) Patent No.: US 8,232,497 B2
(45) Date of Patent: Jul. 31, 2012

(54) RELIEF VALVE FOR DISCHARGING A DIELECTRIC GAS BETWEEN TWO VOLUMES OF A HIGH-VOLTAGE OR MEDIUM-VOLTAGE INTERRUPTING CHAMBER

(75) Inventors: Cyril Gregoire, Villeurbanne (FR); Roger Ledru, Tignieu (FR); Wolfgang Grieshaber, Lyons (FR)

(73) Assignee: Areva T & D SAS, Paris la Defense Cedex (FR)

( * ) Notice: Subject to any disclaimer, the term of this patent is extended or adjusted under 35 U.S.C. 154(b) by 218 days.

(21) Appl. No.: 12/824,018

(22) Filed: Jun. 25, 2010

(65) Prior Publication Data

US 2010/0326958 A1 Dec. 30, 2010

(30) Foreign Application Priority Data

Jun. 29, 2009 (FR) ..... 09 54419

(51) Int. Cl.
*H01H 33/88* (2006.01)

(52) U.S. Cl. ..... 218/66; 218/109

(58) Field of Classification Search ..... 218/66, 218/109
See application file for complete search history.

(56) References Cited

U.S. PATENT DOCUMENTS

| | | | | |
|---|---|---|---|---|
| 3,946,183 | A * | 3/1976 | Milianowicz | 218/66 |
| 3,975,602 | A * | 8/1976 | Hertz et al. | 218/66 |
| 4,354,072 | A * | 10/1982 | Noeske | 218/57 |
| 4,650,942 | A * | 3/1987 | Perret | 218/59 |
| 4,658,108 | A * | 4/1987 | Mauthe | 218/66 |
| 7,820,933 | B2 * | 10/2010 | Heiermeier et al. | 218/60 |
| 2009/0090697 | A1 | 4/2009 | Dufournet et al. | |

FOREIGN PATENT DOCUMENTS

| | | | |
|---|---|---|---|
| DE | 19928079 | A1 | 12/2000 |
| FR | 2709596 | A1 | 3/1995 |

OTHER PUBLICATIONS

French Preliminary Search Report from French Application No. 0954419, dated Feb. 15, 2010, 3 pages.

* cited by examiner

*Primary Examiner* — Truc Nguyen
(74) *Attorney, Agent, or Firm* — Nixon Peabody LLP

(57) ABSTRACT

A relief valve for discharging a dielectric gas between two volumes (V1, V2) of a high-voltage or medium-voltage interrupting chamber. There is used as a closure member a flexible metal blade secured to the body, the closure member therefore being opened by deformation of the flexible blade from a closed position (FIG. 1) in which it is pressed against a closure member seat formed in the body to a fully open position in which it fits closely against a stop member secured to the valve body while remaining within its elastic limit, the open passage for the gas being open in this fully open position (FIG. 1A) and the return of the blade from its fully open position to its closed position being possible because of its flexibility.

12 Claims, 5 Drawing Sheets

RELIEF VALVE FOR DISCHARGING A DIELECTRIC GAS BETWEEN TWO VOLUMES OF A HIGH-VOLTAGE OR MEDIUM-VOLTAGE INTERRUPTING CHAMBER

CROSS REFERENCE TO RELATED APPLICATIONS OR PRIORITY CLAIM

This application claims priority of French Patent Application No. 09 54419, filed Jun. 29, 2009.

DESCRIPTION

1. Technical Field

The invention relates to a relief valve.

The invention applies in particular to a high-voltage or medium-voltage interrupting chamber in which a dielectric gas is to be discharged via a valve.

2. Prior Art

In the field of high-voltage or medium-voltage circuit-breakers, relief valves are widely used to discharge dielectric gas between different volumes of the same chamber when breaking currents.

Numerous patent applications may be mentioned, such as the applicant's application EP 2 045 827, describing the operation of a plurality of relief valves for a double compression volume chamber.

One of the valves 122 described is a unidirectional valve incorporated in an operating tube 108 and its function is to open only if the pressure in the second compression chamber 120 is higher than the pressure in the first compression chamber 106 (arc extinction puffer chamber). Another of the valves described is a filler valve 126 that is used after opening the circuit-breaker to allow gas to enter the second compression chamber 120 when the chamber 100 reverts to the closed configuration.

Whatever the embodiment (closure member material, closure member shape, relative mechanical arrangement of closure member and seat), a relief valve of a high-voltage or medium-voltage interrupting chamber must ideally provide the following functions in addition to its primary function of discharging dielectric gas from one volume to another:

inducing the minimum head loss during filling of at least the puffer volume;

remaining efficient if the circuit-breaker to which it is fitted is exposed to low temperature conditions, typically down to T0=−50° C.;

being highly responsive to opening and closing, i.e. being able to open and close instantaneously if a dielectric gas pressure difference appears across it.

At present, relief valves for discharging the insulating gas in a high-voltage or medium-voltage interrupting chamber can be classified into just two categories: valves with elastomer closure members and valves with metal closure members.

Each of those two categories has its own advantages and disadvantages.

An elastomer closure member is in the form of a washer mounted freely in a passage. Its essential advantages are that it does not induce high head losses during filling and it is responsive to opening and closing. Its major drawback is losing its flexibility if the circuit-breaker fitted with it is exposed to low temperatures.

At low temperatures that kind of elastomer closure member does not necessarily provide a seal, which is an operational hazard.

A metal closure member can take various forms.

A metal closure member can take the form of a washer mounted freely in a passage. Its essential advantage is that it can open and close in a gas-tight manner whatever the temperature conditions, even under severe temperature conditions.

Its major drawbacks are its relatively high weight and the fact that it induces a high head loss because, when open, it partially obstructs the flow section for insulative gas.

A high head loss is detrimental to efficient filling of the puffer volume.

A metal closure member may also take the form of a washer or plate held against an open passage by one or more springs for calibrating the force with which the plate bears against said passage.

The spring or springs may be mounted around a pin or peg for moving the closure member.

The advantage of those return springs is that they make the closure member more responsive to closing or opening, in other words they increase its closing speed. Their major drawbacks are the space required in the chamber for the pin or peg and spring(s), in addition to accommodating the necessary stroke of the closure member, and their increased complexity and cost, because of the number of additional components.

Although little used nowadays, another type of metal closure member is the ball closure member in which a metal ball is mounted freely in an open passage.

The major disadvantages of a ball closure member are the mass of the ball, the imperfect seal it produces, its overall size, and difficulty of implementation.

The object of the invention is to propose a new relief valve that not only retains all the advantages of existing relief valves for discharging a dielectric gas between two volumes of a chamber of a high-voltage or medium-voltage circuit-breaker but also alleviates their drawbacks.

SUMMARY OF THE INVENTION

To this end, the invention provides a relief valve for discharging a dielectric gas between two volumes of a high-voltage or medium-voltage interrupting chamber, the valve comprising a body including at least one open passage with one end that defines a closure member seat, at least one stop member attached to the body and, as a closure member, at least one flexible metal blade interleaved between the closure member seat and the stop member and having one end that is secured to the body, the metal of the blade being adapted to withstand high temperatures up to T1≈2500° C., the flexibility of the blade allowing it to be deformed when gas coming from the open passage is at a pressure higher than gas on the same side as the stop member and in a range of temperatures from T0 to T1 where T0≈−50° C., from its closed position in which it blocks the seat to its fully open position in which it fits closely against the stop member whilst remaining within its elastic limit, said open passage being open in the fully open position of the blade, the flexibility of the blade enabling it to return from its fully open position to its closed position in the absence of any overpressure.

In other words, according to the invention, the closure member is a flexible metal blade, opening being effected by elastic deformation of the blade.

The stop member prevents the blade from reaching its elastic limit: this ensures a long service life compatible with the operating cycles of the circuit-breaker fitted with it.

Using metal for the closure member prevents temperature variations from interfering with its elastic deformation and enables it to preserve its sealing effect.

The flexibility conferred on it enables the open passage through which the dielectric gas is discharged to be completely unobstructed and thus not to induce any head loss therein.

Unlike the prior art, there is no longer any occasion to use closure member calibration springs, as the response time on closing (which is of the order of a few microseconds) is inherent to the intrinsic bending torque that results from clamping the base of the metal blade.

The valve of the invention is perfectly suitable for use in a high-voltage interrupting chamber, since it operates efficiently from −50° C. to 2500° C. at a pressure up to 100 bars and has a service life as high as 10,000 open/close cycles.

In a first embodiment, the body is a circular cylinder and includes a plurality of open passages distributed at the cylindrical periphery of the body and each defining a closure member seat, the valve including a plurality of stop members secured to the body and, as a closure member, a single annular metal blade one end of which is secured to the body and including flexible segments individually interleaved between a closure member seat and a stop member.

The advantages of this first embodiment are its ease of implementation and a shorter assembly time.

In a variant of this first embodiment the annular blade includes an indexing portion enabling it to index each segment angularly on assembly so as to face one of the closure member seats.

In a second embodiment, the body is a circular cylinder and includes a plurality of open passages distributed at the cylindrical periphery of the body and each defining a closure member seat, the valve including a plurality of stop members secured to the body and, as closure members, a plurality of flexible metal blades individually interleaved between a closure member seat and a stop member and each having one end secured to the body.

The advantages of this second embodiment are its increased efficiency in the event of asymmetrical puffing (non-uniform distribution of the puffing flow rate between the different passages), and its reduced cost, as the parts are of simpler design and are all identical.

The open passages are preferably identical to one another, the stop members are preferably identical to one another, and the metal blades are preferably identical to one another.

To produce the flexibility of the blade, it is possible to provide an opening with appropriate dimensions in the portion of the metal blade not facing the closure member seat.

In some configurations, for example when the closure member seat is of metal, so that the seal between the closure member seat and the metal blade is imperfect, it is advantageous if, with an elastomer material blade, the metal blade constitutes a flexible dual material assembly, the elastomer material blade obstructing the closure member seat with direct contact in the closed position of the metal blade.

Alternatively, it is possible for an elastomer material seal to be inserted into a groove formed in the body around the closure member seat, the metal blade being in direct contact with the elastomer material seal in its closed position.

In respect of these embodiments, the person skilled in the art knows that the elastomer does not lose its characteristics at low (or even very low) temperatures. The elastomer used with the metal blade or the seal to constitute the dual material assembly is advantageously of the EPDM (ethylene propylene diene monomer) type, preferably vulcanized using peroxides.

The invention also consists in an interrupting chamber of the automatic pneumatic puffer type including at least one relief valve as described above. An automatic pneumatic puffer chamber is disclosed in patent application EP 1 863 054.

The invention further consists in an interrupting automatic puffer type chamber comprising at least one relief valve as described above.

An automatic puffer chamber is described in patent application FR 2 821 482, for example, and in the patent application EP 2 045 827 referred to above.

The invention finally consists in a high voltage circuit-breaker for voltages greater than 52 kilovolts (kV) and more particularly greater than 170 kV) including an interrupting chamber provided with a relief valve as described above.

BRIEF DESCRIPTION OF THE DRAWINGS

Other advantages and features of the invention emerge more clearly from a reading of the following detailed description given by way of illustrative and non-limiting example with reference to the drawings, in which.

DETAILED DESCRIPTION OF PARTICULAR EMBODIMENTS

The relief valve of the invention includes a body 1 of cylindrical section that separates a first gas volume V1 from a second gas volume V2 in a high-voltage or medium-voltage interrupting chamber.

Figure 1:
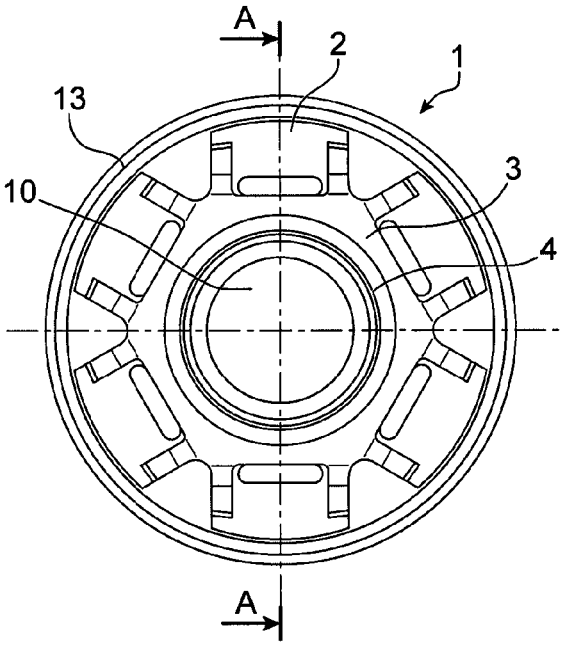
FIGS. 1 and 1A are respectively a front view and a view in longitudinal section of a first embodiment of a relief valve of the invention, its closure member being in the closed position.
Figure 9:
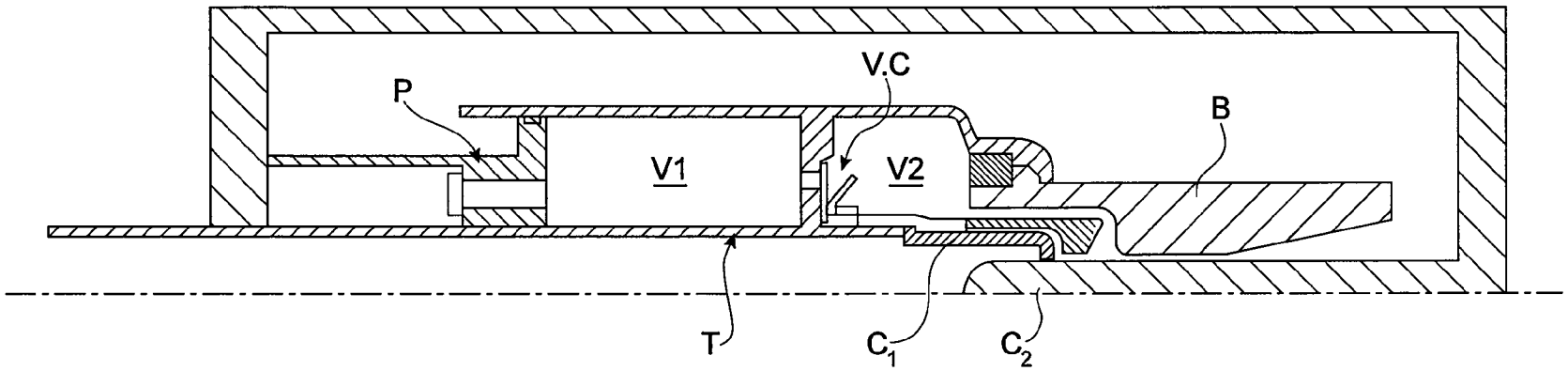
FIG. 9 is a diagrammatic view partly in longitudinal section of an interrupting chamber of a high-voltage circuit-breaker to which a relief valve of the invention is fitted.

To be more precise, the body 1 includes a central bore 10 to be fitted over and fastened around a hollow operating tube T fastened to the mobile arc contact C1 of the chamber, as shown in FIG. 1. The relief valve V.C of the invention is for discharging dielectric gas from the volume V1 to the volume V2 if the action of the operating tube T via the stationary blower piston P causes the pressure to rise in the volume V1. In the chamber represented in FIG. 9, the other contact C2 is fastened.

The closure member of the valve consists of a flexible metal blade 2 that is disposed between the closure member seat 11 and a stop member 3.

The closure member seat 11 is defined at the end of the open passage 12 formed in the valve body 1 and through which gas flows from the volume V1.

Figure 1A:
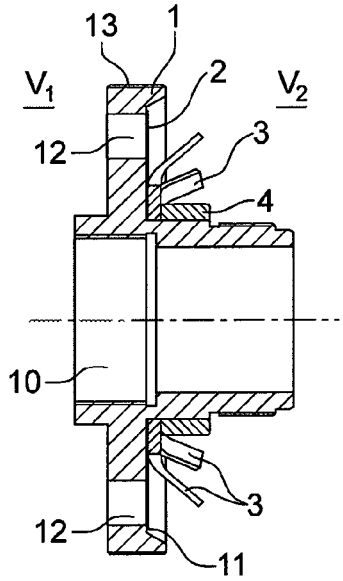
Figure 4:
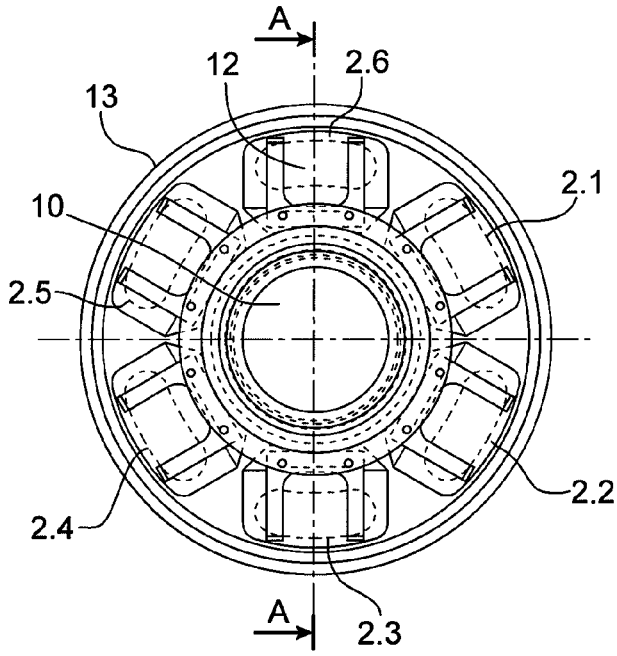
FIGS. 4 and 4A are respectively a front view and a view in longitudinal section of a second embodiment of a relief valve of the invention, its closure members being in the closed position.
Figure 4A:
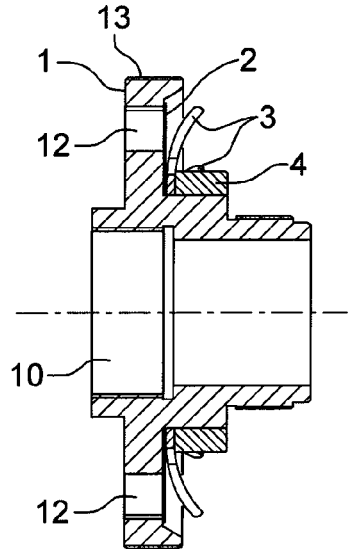
Figure 6:
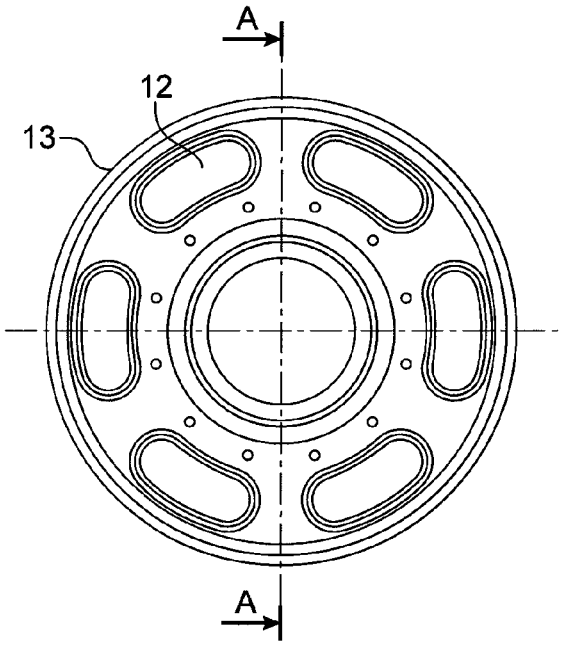
FIGS. 6 and 6A are respectively a front view and a view in longitudinal section of a variant of the relief valve of the invention.
Figure 6A:
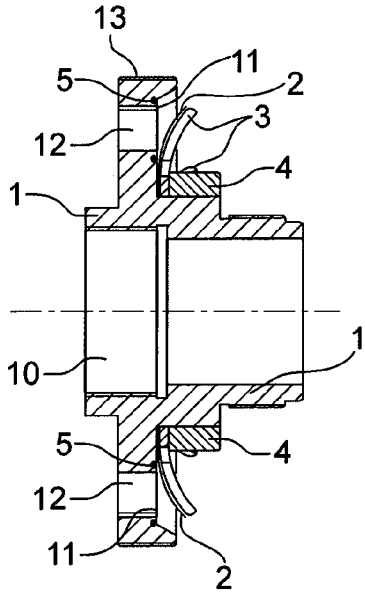
Figure 7:
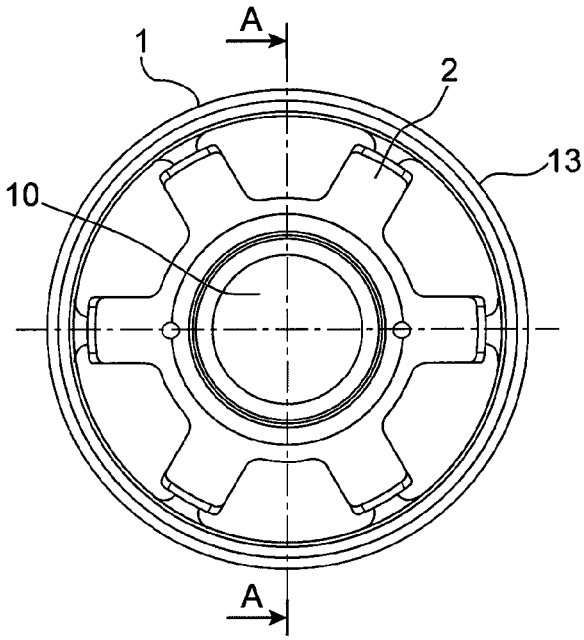
FIGS. 7 and 7A are respectively a front view and a view in longitudinal section of a variant of the first embodiment of a relief valve of the invention, the closure member being in the closed position.
Figure 7A:
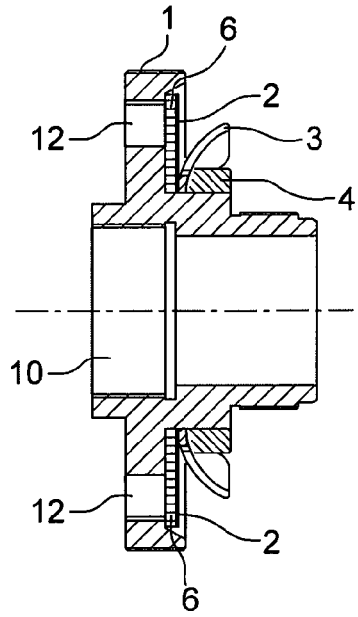

In all the embodiments shown, each metal blade 2, 2.1, 2.2, 2.3, 2.4, 2.5, 2.6 is mounted between a stop member 3 and the valve body 1 and fastened by clamping it. It is clamped by a locking cylinder 4 fastened, preferably screwed, around the valve body 1. In other words, each blade 2, 2.1, 2.2, 2.3, 2.4, 2.5, 2.6 is mounted with its base clamped in the vicinity of the valve seat 11. If there is no pressure difference between the first volume V1 and the second volume V2, the metal blade 2 bears against the closure member seat 11 in a gas-tight manner (FIGS. 1, 1A; FIGS. 4, 4A; FIG. 6; FIGS. 7, 7A). Depending on conditions, gas-tight bearing engagement can be produced:

by direct contact between the metal blade 2 and the valve body 1 (FIGS. 1, 1A; FIGS. 4, 4A);

by direct contact either between the metal blade 2 and an elastomer material seal 5 inserted into a groove 50 formed in the body 1 around the closure member seat 11 (FIGS. 6 and 6A), the metal blade 2 being then in direct contact with the seal 5 in its closed position, or between an elastomer material blade 6 that with the metal blade 2 constitutes a flexible dual material assembly and the valve body (FIGS. 7 and 7A), the elastomer blade 6 then obstructing with direct contact the closure member seat 11 in the closed position.

In the flexible dual material variant, the metal blade 2 act as a closure return spring and thus encourages return of the closure member to the closed position in contact with the closure member seat 11.

The choice can be made as a function of the conditions of use of the high-voltage or medium-voltage circuit-breaker. For example, if direct metal-to-metal contact between the metal blade 2 and the valve body 1 is insufficient to provide a dielectric gas seal at extremely low temperatures (typically down to T0≈−50° C.) of use of the circuit-breaker, then a seal 5 or blade 6 made of elastomer, preferably of EPDM vulcanized using peroxides, can be used.

Figure 2:
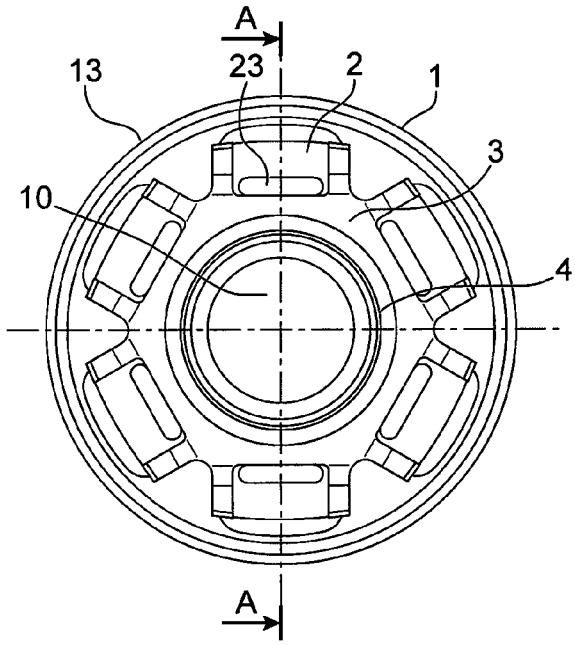
FIGS. 2 and 2A are respectively a front view and a view in longitudinal section of the first embodiment from FIGS. 1 and 1A with the closure member in the fully open position.
Figure 2A:
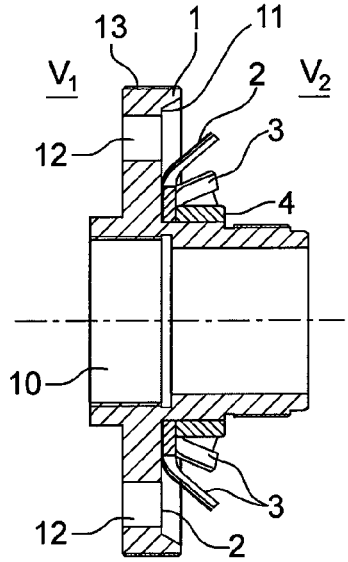
Figure 5:
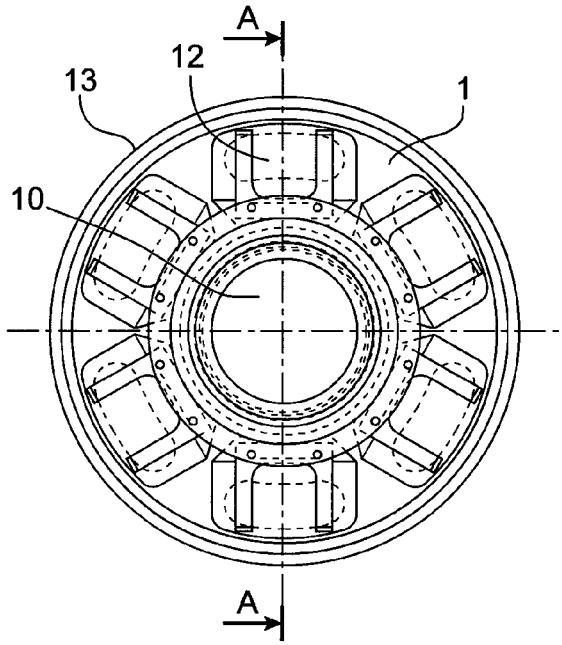
FIGS. 5 and 5A are respectively a front view and a view in longitudinal section of the second embodiment from FIGS. 4 and 4A, the closure members being in the fully open position.
Figure 5A:
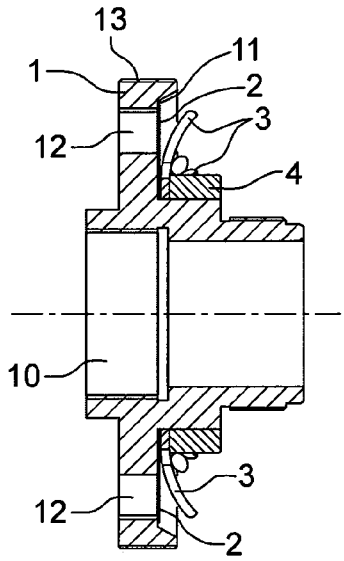

As soon as the first volume V1 is at a higher pressure than the second volume V2, for example on compression of the insulative gas to provide a puff during arc extinction by the circuit-breaker, the metal blade 2 is deformed from its closed position in which it bears against the closure member seat 11 to its fully open position in which it fits closely against the stop member 3, remaining within its elastic limit (FIGS. 2, 2A; FIGS. 5, 5A).

In this fully open position, the open passage 12 is completely unobstructed because of the curvature imparted to the deformed metal blade 2. In other words, the space occupied by the metal blade 2 does not induce any head loss on opening the closure member.

When the gas pressure rises in the second volume V2 and the pressure in the first volume V1 is therefore not higher than that in the second volume V2, the metal blade is closed and constitutes a gas-tight partition between the two volumes V1 and V2.

The metal of the blade 2 is typically adapted to withstand high temperatures up to T1≈2500° C. The blade 2 is advantageously produced from blued steel strip.

The flexibility of each blade is typically adapted to enable it to be deformed in a range of temperatures from T0 to T1 where T0≈−50° C. and T1≈2500° C.

Figure 3:
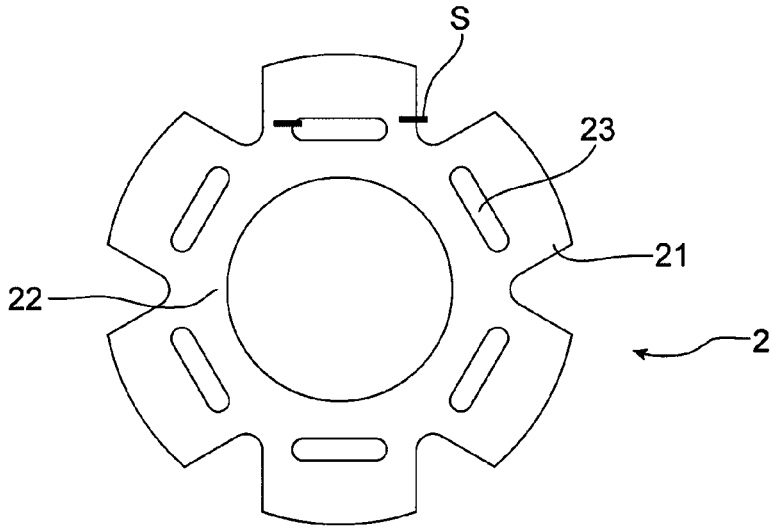
FIG. 3 is a front view of a closure member of the invention.

In the embodiment shown in FIGS. 1 to 3 and FIGS. 7 to 8A, the body is a circular cylinder and includes a plurality of open passages 12 distributed over the cylindrical periphery 13 of the body 1 and each defining a closure member seat. The valve includes six stop members 3 secured to the body. Here the closure member consists of a single annular metal blade 2 (FIG. 3). This blade 2 includes six identical flexible segments 21. All the segments 21 are individually interleaved between a closure member seat 11 and a stop member 3. All the segments 21 are deformed in the same manner and each fits closely against the profile of the corresponding stop member 3 in its fully open position (FIGS. 2 and 2A) in which the corresponding passage 12 is completely unobstructed.

As shown in FIG. 3, the blade 2 includes a portion 22 for angularly indexing each segment 21 in front of an open passage 12.

The flexibility and thus the opening torque of the metal blade 2 can be adjusted by the section S of the blade in the region of the hinge portion (FIG. 3). The dimensions of the section S, in other words the aperture 23, can thus be chosen as a function of the pressure of the gas in the volume V1 relative to that of the gas in the volume V2. Obviously, the chosen material and dimensions of the metal blade 2 must also be determined as a function of the deformation of the blade 2 required on opening and closing.

In the embodiment shown in FIGS. 4 to 5A, the body 1 is a circular cylinder 13 and includes a plurality of open passages 12 distributed at the cylindrical periphery 13 of the body and each defining a closure member seat 11. The valve includes six stop members secured to the body and, as closure members, a plurality of flexible metal blades 2.1, 2.2, 2.3, 2.4, 2.5, 2.6 individually interleaved between a closure member seat 11 and a stop member 3. All the blades 2.1, 2.2, 2.3, 2.4, 2.5, 2.6 are deformed in the same manner and each fits closely against the profile of the corresponding stop member 3 in the fully open position (FIGS. 5 and 5A) in which the corresponding passage 12 is completely unobstructed.

Here the open passages 12 are identical to one another, the stop members 3 are identical to one another, and the metal blades 2 are identical to one another.

Figure 8:
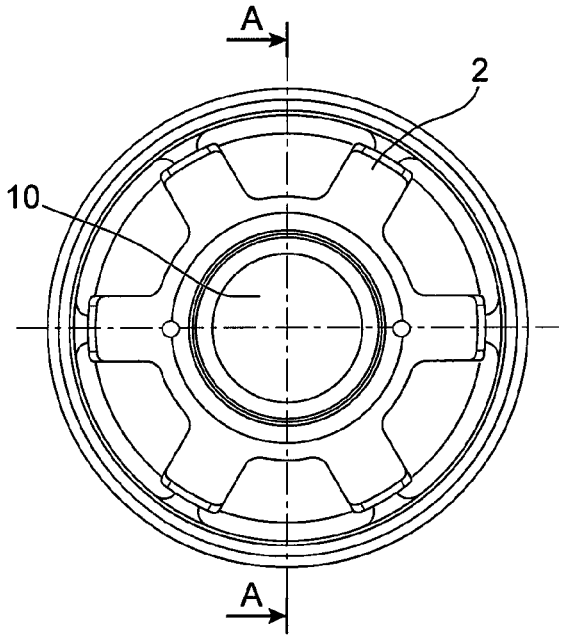
FIGS. 8 and 8A are respectively a front view and a view in longitudinal section of the variant of the first embodiment from FIGS. 7 and 7A with closure member in a partly open position.
Figure 8A:
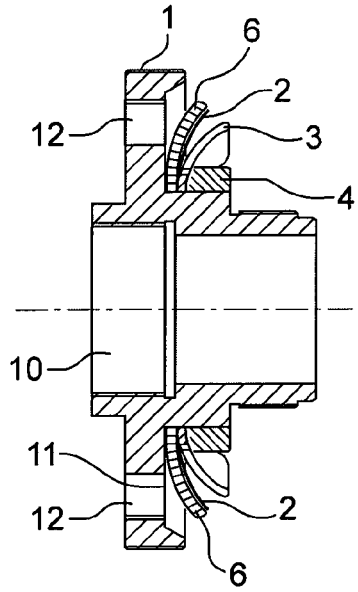

Shown in its partly open position in FIGS. 8 and 8A, the flexible dual material assembly of the invention consists of a metal blade 2 and an elastomer (EPDM vulcanized using peroxides) blade 6 superposed one on the other.

The advantages of a relief valve of the invention as described above are numerous:

compactness, which is advantageous if a relief valve is installed in a chamber of a high-voltage or medium-voltage circuit-breaker;

easy assembly (metal blade, stop member, locking piece on valve body);

lower fabrication and assembly costs;

lower pressure drop between the volumes V1 and V2 because of the lower head loss;

lower mass of the valve because of the lower mass of the metal blade;

resistance to extreme temperatures to which the high-voltage or medium-voltage circuit-breaker may be subjected;

the closure member is highly responsive to opening and closing, with a response time of the order of a few microseconds, because of the low inertia of the metal blade;

reduced risk of malfunction in operation of the high-voltage or medium-voltage circuit-breaker.

The invention claimed is:

1. A relief valve for discharging a dielectric gas between two volumes (V1, V2) of a high-voltage or medium-voltage interrupting chamber, the valve comprising:

a body including at least one open passage with one end that defines a closure member seat, at least one stop member attached to the body and as a closure member, at least one flexible metal blade interleaved between the closure member seat and the stop member and having one end that is secured to the body, the metal of the blade being adapted to withstand high temperatures up to T1≈2500° C., the flexibility of the blade allowing it to be deformed when gas coming from the open passage (V1, V2) is at a pressure higher than gas on the same side (V2) as the stop member and in a range of temperatures from T0 to T1 where T0≈−50° C., from its closed position in which it blocks the seat to its fully open position in which it fits closely against the stop member whilst remaining within its elastic limit, said open passage being open in the fully open position of the blade, the flexibility of the blade enabling it to return from its fully open position to its closed position in the absence of any overpressure.

2. A relief valve according to claim 1, wherein the body is a circular cylinder and includes a plurality of open passages distributed at the cylindrical periphery of the body and each defining a closure member seat, the valve including a plurality of stop members secured to the body and, as a closure member, a single annular metal blade one end of which is secured to the body and including flexible segments individually interleaved between a closure member seat and a stop member.

3. A relief valve according to claim 2, wherein the annular blade includes an indexing portion enabling it to index each segment angularly on assembly so as to face one of the closure member seats.

4. A relief valve according to claim 1, wherein the body is a circular cylinder and includes a plurality of open passages distributed at the cylindrical periphery of the body and each defining a closure member seat, the valve including a plurality of stop members secured to the body and, as closure members, a plurality of flexible metal blades individually interleaved between a closure member seat and a stop member and each having one end secured to the body.

5. A relief valve according to claim 4, wherein the open passages are identical to one another, the stop members are identical to one another, and the metal blades are identical to one another.

6. A relief valve according to claim 1, wherein the metal blade portion not facing the closure member seat is provided with an aperture with its dimensions chosen to produce the flexibility of the blade.

7. A relief valve according to claim 1, wherein, with an elastomer material blade, the metal blade constitutes a flexible dual material assembly, the elastomer material blade obstructing the closure member seat with direct contact in the closed position of the metal blade.

8. A relief valve according to claim 1, wherein an elastomer material seal is inserted into a groove formed in the body around the closure member seat, the metal blade being in direct contact with the elastomer material seal in its closed position.

9. A relief valve according to claim 7, wherein the elastomer material of the blade or the seal is an EPDM, preferably vulcanized using peroxides.

10. An interrupting chamber of the automatic pneumatic puffer type, including at least one relief valve according to claim 1.

11. An interrupting chamber of the automatic puffer type, including at least one relief valve according to claim 1.

12. A high voltage circuit-breaker, for high voltages greater than 52 kV and more particularly greater than 170 kV, including an interrupting chamber fitted with a relief valve according to claim 1.

* * * * *